United States Patent [19]

Sims

[11] 4,228,532

[45] Oct. 14, 1980

[54] PIEZOELECTRIC TRANSDUCER

[76] Inventor: Claude C. Sims, 1308 Heron Dr., Orlando, Fla. 32803

[21] Appl. No.: 7,435

[22] Filed: Jan. 29, 1979

[51] Int. Cl.[3] ..... H04R 17/00

[52] U.S. Cl. ..... 367/159; 367/155; 367/164; 310/337; 310/367; 310/371

[58] Field of Search ..... 367/153, 155, 157, 158, 367/159, 164, 165, 166; 310/337, 367, 371

[56] References Cited

U.S. PATENT DOCUMENTS

| | | | |
|---|---|---|---|
| 2,618,698 | 11/1952 | Janssen | 367/164 |
| 2,966,656 | 12/1960 | Bigbie et al. | 367/157 |
| 3,266,011 | 8/1966 | Massa | 367/164 |
| 3,560,914 | 2/1971 | Webb | 367/157 |
| 3,617,780 | 11/1971 | Benjaminson | 310/367 |
| 3,947,802 | 3/1976 | Tims et al. | 367/159 |

FOREIGN PATENT DOCUMENTS

| | | | |
|---|---|---|---|
| 1008554 | 12/1977 | Canada | 367/159 |

*Primary Examiner*—Harold J. Tudor

*Attorney, Agent, or Firm*—Duckworth, Hobby & Allen

[57] ABSTRACT

An electroacoustic transducer having high acoustic-to-electric energy conversion per unit volume. The transducer is in the form of a body having a cylindrical central section and hemispherical end sections, the central section and the end sections formed from active piezoelectric material and electrically interconnected with respect to a pair of output terminals wherein the polarizations of the central section and the end sections are arranged to convert acoustic pressure on the entire external surface area of said body to be effective in producing electrical energy. The physical parameters of each section are matched to produce essentially equal electrical characteristics of each section to form an inherently symmetrical transducer. The transducer has high sensitivity for a small size and is especially adapted for use in thin line towed arrays. The symmetrical form, polarities and balanced connections of the transducer provide cancellation of forces due to acceleration.

14 Claims, 3 Drawing Figures

PIEZOELECTRIC TRANSDUCER

BACKGROUND OF THE INVENTION

1. Field of the Invention

The present invention relates to an acoustic transducer, and especially to a transducer having small size, high sensitivity and high capacitance which produces a high efficiency of conversion from acoustical energy to electrical energy.

2. Description of the Prior Art

In the construction of towed hydrophone arrays to be used as underwater listening devices, it is common to use a number of acoustical transducers interconnected and encased in tubular jackets, or the like. To achieve the required sensitivities, prior art arrays have necessarily utilized physically large transducers. Certain applications of towed arrays require a thin line configuration presenting difficult design problems. Previous towed arrays also have suffered from spurious signals produced by acceleration forces as the hydrophone is pulled through the water. Various methods have been proposed to substantially cancel such spurious signals, including back-to-back hydrophones having hydrostatic pressure compensation. However, a need still exists for a physically small efficient acoustical transducer having inherent acceleration cancellation characteristics.

SUMMARY OF THE INVENTION

The present invention is a novel piezoelectric acoustical transducer that utilizes its total external surface area for converting acoustical pressure incident thereon to force on the piezoelectric material, thereby obtaining maximum energy conversion efficiency per unit volume of the transducer.

In its basic configuration, the transducer consists of a hollow, cylindrical center section with a hollow, hemispherical cap secured to each end. Typical overall dimensions may be 1½ inches in length and ½ inch in diameter. The end caps, formed from one type of lead zirconate titanate ceramic, are radially polarized and are of opposite polarities. The cylindrical center section is formed from two circumferentially polarized cylinders joined together and of a second type of lead zirconate titanate ceramic. Each section has deposited silver coatings on the outer and inner surfaces thereof forming the necessary electrodes. Advantageously, all adjacent sections of the transducer are of opposite polarities and the sections are electrically connected in a series-aiding relationship such that the output of the transducer is the sum of the output from each section.

The physical parameters of each section, such as the type of ceramic, capacitance of each section, and the dimensions, may be selected to obtain essentially equal sensitivities of each section to thereby maximize the transducer performance. The transducer shape provides inherent strength, allowing relatively thin section walls for a given hydrostatic pressure. The capacitance between electrodes for each section increases as the wall thickness of the section is reduced. Since the energy produced by the piezoelectric material is directly proportional to this capacitance, minimum wall thickness, which may be achieved with this invention, results in maximum sensitivity.

For a required total sensitivity, a transducer according to the instant invention can be made with smaller volume and external dimensions that prior art transducers, resulting in very wide frequency bandwidth elements eminently suited for thin line towed arrays.

As may be noted, the end caps utilized in the transducer are of opposite polarities. Connecting the end caps in a series-aiding relationship thereby provides an inherent cancellation of acceleration forces since such forces produce extension on one end of the towed device and compression on the opposite end. Therefore, the polarities of the signals herein produced will be opposite and essentially equal by virtue of the matching of the sensitivities of the end caps, resulting in effective cancellation.

It is therefore a principal object of the invention to provide a physically small acoustic transducer having a high efficiency of conversion of acoustical energy to electrical energy.

It is another object of the invention to provide a physically small acoustic transducer having high sensitivity, high capacitance, and broad frequency response.

It is yet another object of the invention to provide an acoustical transducer in which the entire external surface area is of piezoelectric materials.

It is still another object of the invention to provide a multiple section acoustic transducer having the sections electrically connecting in a series-aiding configuration with respect to its output leads, wherein each section is of approximately equal sensitivity.

It is a further object of the invention to provide an acoustic transducer having a size and form factor particularly suited for thin line towed arrays.

It is yet a further object of the invention to provide an acoustic transducer in which signals from acceleration forces are cancelled.

These and other objects and advantages of my invention may be noted from the detailed description hereinbelow read in view of the drawings.

DETAILED DESCRIPTION OF THE PREFERRED EMBODIMENT

Figure 1:
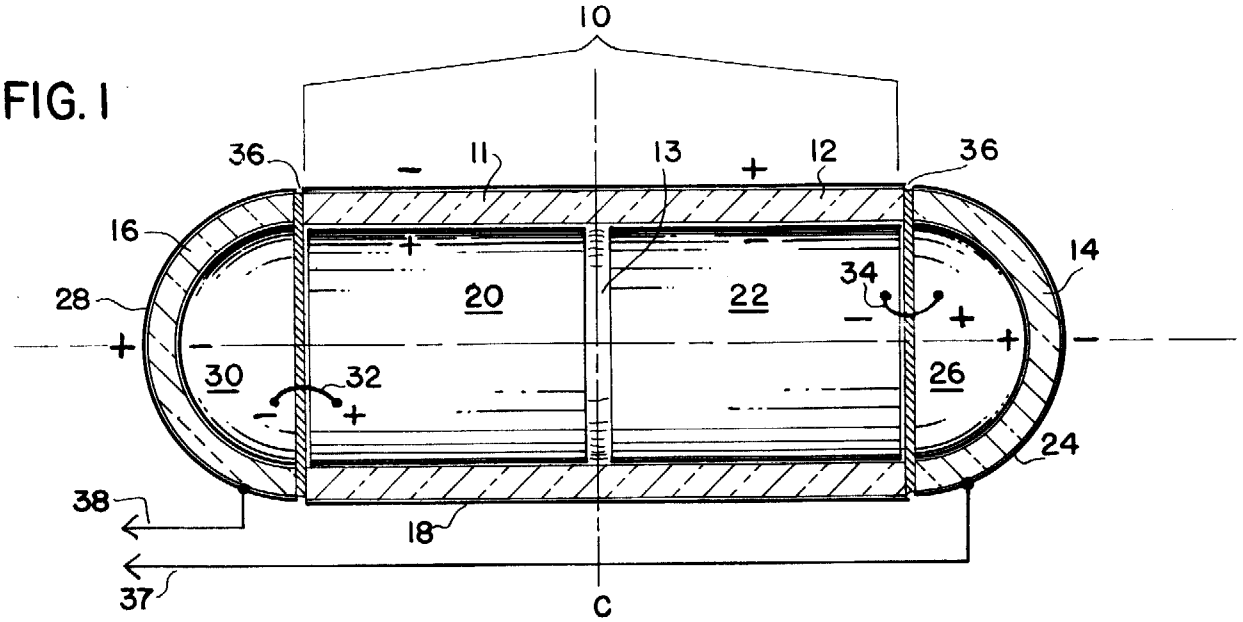
FIG. 1 is a cross sectional view of a typical transducer in accordance with the invention.

Referring to FIG. 1, a cross sectional side view of the novel transducer is shown. The transducer assembly consists generally of a center section 10 and two hemispherical end caps 14 and 16. The end caps 14 and 16 are attached to the respective ends of cylinder 10 by nonconductive epoxy 36. The end caps and the central cylindrical section 10 are formed from an active piezoelectric material having their respective inner and outer surfaces silver plated to form electrodes. Advantageously, the central section 10 is subdivided into two sections 11 and 12 by dividing the inner conductive coating into two electrodes 20 and 22. These independent coatings thereby leave a gap 13 between the respective inner electrodes. A continuous outer coating 18 is provided on cylinder 10 producing a common electrode.

In accordance with the invention, the end caps 14 and 16 are radially polarized. End cap 16 may have one polarity, for example, positive with respect to its outer surface and negative with respect to its inner surface, in which case cap 14 would be oppositely polarized as shown. The central cylinder 10 is circumferentially polarized with one section, for example, section 11, being polarized with its external surface having a negative polarity and its inner surface having a positive polarity. Section 12, on the other hand, is oppositely polarized. It may now be recognized that connecting the four separate sections in series results in the sum of the voltages produced by each section appearing with respect to output leads 37 and 38. Lead 32 connects cap 16 to cylindrical section 11, and lead 34 connects the positive pole of end cap 14 to the negative pole of cylindrical section 12. Cylindrical sections 11 and 12 are effectively in series by virtue of the common electrode coating 18 which represents the negative pole of section 11 and the positive pole of section 12.

The transducer in accordance with the invention is to be supported in its hydrophone housing by a concentric ring of resilient material about its center line C of FIG. 1. As the transducer is towed through the water along its longitudinal axis, acceleration forces cause a shortening of the forward element and an elongation of the rearward element; in this case, hemispherical caps 14 and 16. Due to the opposite polarities of the caps, and the series connection thereof, the varying signals thus produced will be 180° out-of-phase. Since caps 14 and 16 are identically matched with respect to capacitance and sensitivity, the out-of-phase signals will have equal amplitude and will therefore cancel.

In the embodiment illustrated by FIG. 1, the center section 10 comprises the two seriesed sections 11 and 12. It may be advantageous in certain designs to utilize more than two sections and it is within the scope of the invention to add additional pairs of cylindrical sections. Adding such additional elements in pairs maintains the desired balanced series arrangement.

It is a key aspect of the invention that the effective sensitivity of each of the four sections shown in the exemplary configuration of FIG. 1 be essentially equal to provide a smooth frequency response and symmetrical directivity patterns. This objective is achieved by selection of the various variables in the design; for example, the sensitivities of the cylindrical sections are balanced by the symmetrical configuration of the conductive coatings forming the electrodes thereof. To match the sensitivity of end caps 14 and 16 with that of the center sections 11 and 12, a piezoelectric material of different characteristics may be selected in order that the particular hemispherical size will produce essentially equal sensitivity and have similar capacitance.

Having presented a general disclosure of the form of the novel transducer, typical design will now be described. However, it will be apparent to those skilled in the art that many variations in size and materials, as well as number of elements, may be made without departing from the scope of the present invention. Such variations advantageously will allow application of the invention to a wide variety of uses with respect to sensitivity, frequency response, and the like. In a typical unit, referring again to FIG. 1, the length of center section 10 may be 1 inch with an outside diameter of ½ inch. The material selected for section 10 may be PZT-5$H_o$, which is a lead zirconate titanate piezoelectric material with its sensitivity controlled by certain additives. The wall thickness of the cylinder may be 0.050 inches. End caps 14 and 16 may be formed from PZT-5 lead zirconate titanate piezoelectric material having a different additive material to thereby balance the sensitivities between the end caps and the cylindrical elements. The outside major diameter of end caps 14 and 16 may be 0.480 inches with 0.031 inches wall thickness. To illustrate the balance obtained from this exemplary configuration, the sensitivity formed for the hemispheres was −204 dB re one volt per micropascal, while the sensitivity for one section of the cylindrical element was −202 dB re one volt per micropascal. The capacitance of the cylinder was 4,020 pf and the capacitance of the hemispheres was 4,000 pf. With the series connection of the elements, the measured sensitivity had a total of −191.5 dB re one volt per micropascal and a measured capacitance of 1,500 pf.

The novel shape of transducer in accordance with the invention provides high structural strength. The typical unit as described above has been found to be operable under hydrostatic pressures up to 2,000 psi and to withstand pressures of up to 5,000 psi.

Figure 2:
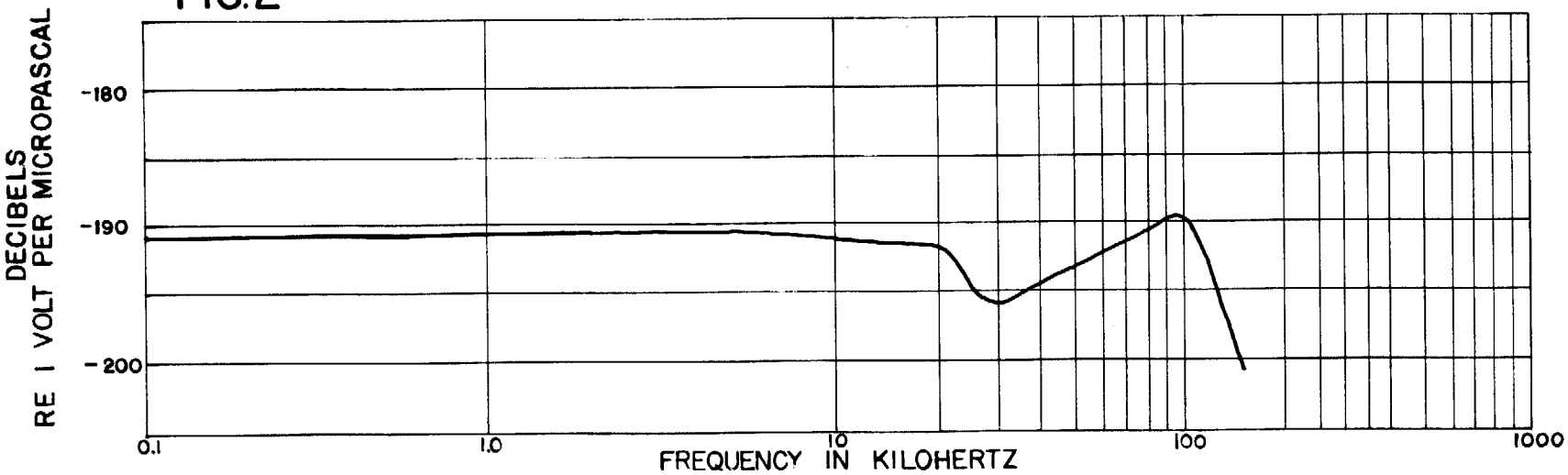
FIG. 2 is a logarithmic plot of the free field voltage sensitivity of an exemplary configuration of the invention.

As may now be recognized, a highly sensitive and small size acoustical transducer has been disclosed having its entire surface area of active piezoelectric material. The small size also advantageously produces a very wide frequency response. Turning now to FIG. 2, the open circuit voltage on output leads 37 and 38 is shown as a function of frequency. As may be noted, the free field sensitivity is essentially flat from 100 hertz or 20 kilohertz within 1 dB and extends to over 100 kilohertz for its upper band width limit.

Figure 3:
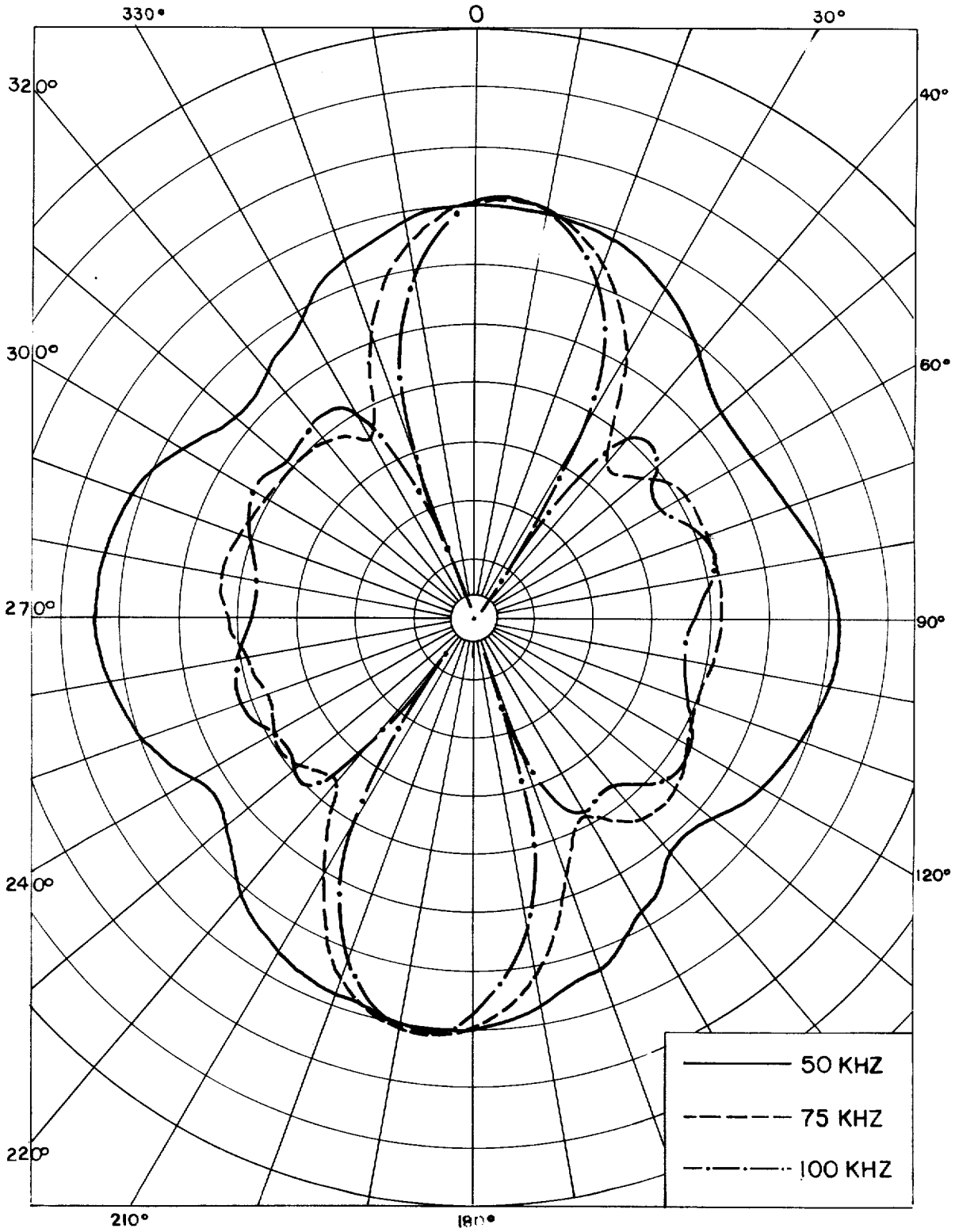
FIG. 3 represents a typical directivity pattern in the horizontal plane for an exemplary configuration of the invention, with the measurement made at 50, 75 and 100 kHz.

The transducer has an essentially omnidirectional characteristic over the flat region of its frequency response. Referring to FIG. 3, a polar plot of frequency response is shown for the higher frequency points. As may be noted, at 50 kilohertz a reasonably uniform directivity pattern is achieved with the nulls becoming more pronounced as the upper limit of frequency is reached. Sensitivity is seen to be good at 100 kilohertz with only very narrow nulls being apparent.

As may now be recognized, a novel acoustic transducer has been disclosed having a small physical size for a given sensitivity by virtue of its utilization of the total external surface area for absorption of sound energy. The elongate form and small diameter make the invention particularly appropriate for construction of thin line array hydrophones having inherent cancellation of spurious signals due to acceleration forces. Although the preferred embodiment has been described herein, this is not to be taken as in any way limiting the invention, but merely as being descriptive thereof. The invention therefore foresees changes in types of piezoelectric materials, thickness, dimensions and numbers of the disclosed elements to tailor the invention to various desired application.

I claim:

1. An electroacoustic transducer having high acoustic-to-electric energy conversion per unit volume comprising:

a pair of output terminals; and a body having a cylindrical central section and hemispherical end sections, said central section is formed from a first type of active pieozoelectric material and said end sections are formed from a second type of active piezoelectric material and electrically interconnected with respect to said output terminals wherein the polarizations of said central section and said end sections are arranged to convert acoustic pressure on the entire external surface area of said body to be effective in producing electrical energy.

2. The transducer as defined in claim 1 in which:

said central section is a hollow cylinder having two seriesconnected circumferentially polarized elements;

said end sections are radially polarized hollow hemispheres in series-connected relationship with said central section with respect to said pair of output terminals; and said first type of piezoelectric material and said second type of piezoelectric material are selected to provide equal electrical sensitivities of each of said two elements of said central section and said end sections.

3. The transducer as defined in claim 2 in which the sensitivities and the polarities of said end sections are selected to provide inherent cancellation of electrical signals generated in said transducer due to acceleration forces occurring along the longitudinal axis of said body.

4. The transducer as defined in claim 2 in which said two circumferentially polarized elements are formed from a common ceramic cylinder having a continuous electrode over one cylindrical surface and two separate electrodes over the other cylindrical surface.

5. An electroacoustic transducer comprising:

a pair of circumferentially polarized hollow piezoelectric cylinders, said pair of cylinders having equal diameters connected concentrically end to end, each one of said pair of piezoelectric cylinders formed from a first material having selected thickness and characteristics to produce a desired capacitance;

a pair of radially polarized hollow hemispherical piezoelectric end caps having major diameters essentially equal to the diameter of said cylinders, said caps attached to the outside ends of said pair of cylinders, each one of said pair of piezoelectric end caps formed from a second material having selected thickness and characteristics to produce said capacitance; and a pair of leads connected to said transducer, said pair of cylinders and said pair of caps being interconnected electrically in a series-aiding relationship with respect to said pair of leads.

6. The transducer as defined in claim 5 in which the thickness of said pair of hollow piezoelectric end caps differs from the wall thickness of said hollow piezoelectric cylinders, thereby providing a balance of electrical characteristic therebetween.

7. The transducer as defined in claim 5 in which:

said pair of polarized hollow piezoelectric cylinders are oppositely polarized; and said pair of polarized hollow piezoelectric end caps are oppositely polarized.

8. The transducer as defined in claim 7 in which the polarity of each of said end caps is opposite to the polarity of its adjacent attached cylinder.

9. The transducer as defined in claim 8 in which electrical signals produced in response to acceleration of said transducer along its longitudinal axis are essentially cancelled.

10. The transducer as defined in claim 8 in which said cylinders have a combined length of about one inch, a diameter of about one-half inch and said end caps have a radius of about onefourth inch and in which the sensitivity of said transducer is greater than about −195 dB re one volt per microposcal over a selected frequency range.

11. An electroacoustic transducer having high acoustic-to-electric energy conversion per unit volume comprising:

1. a pair of output terminals; and 2. a body having (a) a hollow cylindrical center section formed from a first type of active piezoelectric material, such section having two cylinders mechanically connected concentrically end to end, said two cylinders circumferentially polarized with opposite polarities and electrically connected in a series-aiding manner; and (b) hemispherical end sections formed from a second type of active piezoelectric material, said two end sections radially polarized with oppostie polarities and electrically connected with said central section in a series-aiding manner;

wherein said pair of output terminals is connected to said body so that the entire external surface area of said body is effective in producing electrical energy.

12. The transducer as defined in claim 11 in which said first type of piezoelectric material and said second type of piezoelectric material are selected such that the electrical sensitivity of each of said cylinders and each of said end sections is essentially equal.

13. The transducer as defined in claim 12 in which the sensitivities of said end sections and the polarities of said end sections are selected to provide inherent cancellation of acceleration forces occurring along the longitudinal axis of said body.

14. An electroacoustic transducer having high volumetric efficiency of acoustic-to-electric energy transfer for use in hydrophone thin line arrays comprising:

a first hollow hemispherical radially polarized piezoelectric active element having a selected electrical sensitivity;

a first hollow cylindrical circumferentially polarized piezoelectric active element having an inside diameter essentially equal to the major inside diameter of said first hemispherical element having essentially said selected electrical sensitivity and having an opposite polarization from said first hemispherical element, a first end of said first cylindrical element nonconductively secured to the major diameter face of said first hemispherical element;

a second hollow cylindrical circumferentially polarized piezoelectric active element having a diameter essentially equal to the diameter of said first cylindrical element having essentially said selected electrical sensitivity and having an opposite polarization from said first cylindrical element, a first end of said second cylindrical element non-conductively secured to the second end of said first cylindrical element;

a second hollow hemispherical radially polarized piezoelectric active element having a major inside diameter essentially equal to the inside diameter of said second cylinder having essentially said selected electrical sensitivity and having an opposite polarization from said second cylindrical element, the major diameter face of said second hemispherical element non-conductively secured to the second end of said second cylindrical element; and a pair of conductors connecting to said transducer wherein said elements are interconnected electrically in a series-aiding relationship with respect to said pair of conductors and said oppositely polarized hemispherical elements cause cancellation of electrical signals produced by acceleration forces acting along the longitudinal axis of said transducer.

* * * * *